US009858746B2

(12) United States Patent
Van Dam et al.

(10) Patent No.: US 9,858,746 B2
(45) Date of Patent: Jan. 2, 2018

(54) CONTROLLER FOR GAMING DEVICES

(71) Applicant: DR GAMING TECHNOLOGY EUROPE NV, Knokke (BE)

(72) Inventors: Michiel Van Dam, Knokke (BE); Jurgen De Munck, Knokke (BE)

(73) Assignee: DR GAMING TECHNOLOGY EUROPE NV, Knokke (BE)

( * ) Notice: Subject to any disclaimer, the term of this patent is extended or adjusted under 35 U.S.C. 154(b) by 0 days.

(21) Appl. No.: 14/431,234

(22) PCT Filed: Oct. 1, 2013

(86) PCT No.: PCT/EP2013/070409

§ 371 (c)(1),
(2) Date: Mar. 25, 2015

(87) PCT Pub. No.: WO2014/053465

PCT Pub. Date: Apr. 10, 2014

(65) Prior Publication Data

US 2015/0262448 A1 Sep. 17, 2015

Related U.S. Application Data

(60) Provisional application No. 61/708,645, filed on Oct. 2, 2012.

(51) Int. Cl.
*G07F 17/32* (2006.01)

(52) U.S. Cl.
CPC ..... *G07F 17/3209* (2013.01); *G07F 17/3211* (2013.01); *G07F 17/3223* (2013.01); *G07F 17/3225* (2013.01)

(58) Field of Classification Search
None
See application file for complete search history.

(56) References Cited

U.S. PATENT DOCUMENTS

2002/0052230 A1 5/2002 Martinek
2004/0043814 A1 3/2004 Angell
(Continued)

FOREIGN PATENT DOCUMENTS

WO 99/60498 A1 11/1999
WO 2007/075797 A2 7/2007
WO 2011/066593 A1 6/2011

OTHER PUBLICATIONS

International Report on Patentability (dated Apr. 16, 2015) for International PCT Patent Application No. PCT/EP2013/070409, filed Oct. 1, 2013.
(Continued)

*Primary Examiner* — Jay Liddle
*Assistant Examiner* — Alex F. R. P. Rada, II
(74) *Attorney, Agent, or Firm* — Joseph G. Chu; JCIP

(57) ABSTRACT

A controller (100) for gaming devices comprises interfaces (109, 110) connectable to various devices of the gaming device, such as a gaming processor (103), at least one screen (101, 02), which is optionally configured as a touch screen, and a loud speaker (113). Each interface (109, 110) comprises a plurality of connectors selected from a video input connector, a video output connector, an audio input connector, an audio output connector, a touch screen signal input connector, a touch screen signal output connector, a command line connector and/or a data connector. The controller routes signals received at an input connector of a first interface (109, 110) to an output connector of a second interface (110, 09) being assigned to said signal. When necessary, the controller translates a communication protocol used by the signals received at the input connector of the first interface to a communication protocol used by the output connector of the second interface.

6 Claims, 6 Drawing Sheets

(56) References Cited

U.S. PATENT DOCUMENTS

| | | | | |
|---|---|---|---|---|
| 2005/0020358 | A1 | 1/2005 | Cram | |
| 2005/0096125 | A1* | 5/2005 | LeMay | G07F 17/32 463/25 |
| 2005/0239545 | A1* | 10/2005 | Rowe | G07F 17/32 463/29 |
| 2005/0239546 | A1* | 10/2005 | Hedrick | G07F 17/0014 463/29 |
| 2006/0068907 | A1 | 3/2006 | Dimichele | |
| 2006/0073887 | A1* | 4/2006 | Nguyen | G07F 17/3258 463/27 |
| 2008/0009344 | A1* | 1/2008 | Graham | G07F 17/32 463/25 |
| 2009/0149254 | A1* | 6/2009 | Kelly | G07F 17/3211 463/36 |
| 2010/0048288 | A1 | 2/2010 | Canterbury | |
| 2010/0081500 | A1 | 4/2010 | Phillips | |
| 2012/0064975 | A1 | 3/2012 | Gault et al. | |

OTHER PUBLICATIONS

International Search Report (dated Dec. 5, 2013) for International PCT Patent Application No. PCT/EP2013/070409.
Written Opinion of the International Searching Authority for International PCT Patent Application No. PCT/EP2013/070409.

* cited by examiner

CONTROLLER FOR GAMING DEVICES

The invention relates to the field of amusement and gaming devices and in particular to gaming devices comprising at least one screen, optionally configured as a touch screen, and a gaming processor controlling the at least one screen.

In casinos multiple electronic gaming devices are linked in a network. Data are exchanged among the devices and interaction between a player of the electronic gaming device and the electronic gaming device as well as an online system communicating with the electronic gaming device takes place. For the interaction between the player and the electronic gaming device the gaming devices has interactive equipment such as one or more screens, touch screens, other display types, buttons etc. The online system offers cashless transactions, monitoring, bonusing, player tracking, point of sales, advertisement, live gaming video feed, side games etc.

For the interaction between the player and the online system either separate interactive devices such as screens, touch screens, other displays, buttons, etc. are implemented in the electronic gaming device, or existing devices of the electronic gaming devices are used for this interaction between the player and the online system. When the existing interactive devices of the electronic gaming device are used a controller manages sharing of these existing interactive devices between the gaming processor and the online system, particularly by using resizing, overlay, picture-in-picture techniques to show both gaming and online information on an existing screen of the gaming device, or switching between displaying either the output-information from the gaming processor or the output-information from the online system on the screen and forwarding the input-information from an existing touch-screen or buttons either to the gaming system or to the online system.

A typical electronic gaming device has two screens, one preferably being configured as a touch screen, buttons, a unit for booking money to the credit meter and a cashout mechanism for the interaction with the player. When separate input and output devices are used, there are additional displays and buttons for this type of interaction.

The online system is connected to the electronic gaming devices to monitor the electronic gaming devices, and to receive data from the gaming devices for recording and monitoring gaming floor information. This online system offers the possibility of information exchange, cashless gaming, player tracking, bonusing and casino promotions and services.

When the input and output devices of the electronic gaming device are used for the communication between a player and the online system, there are two different possibilities of how to make the screens of the electronic gaming device useable for the online system. The first option is to switch input or output signals to and from the various devices. The second option is that the electronic gaming device and the online system share the input and output devices, as described in WO 2011/066593 A1.In each case a controller performs partitioning of the system components between the gaming device and the online system.

Traditionally, in order to meet the preferences of all guests, there is a variety of different gaming devices in a casino, which may even comprise fairly old models of gaming devices having still their fan base. This leads to problems regarding the integration of the variety of gaming devices in a casino online system.

For the technical service team of the casino there is also the problem that a huge stock of spare parts is needed for maintaining all the different types of electronic gaming devices. For instance, it is often impossible or at least very complicated to replace screens of gaming devices due to the large variety of types of video connectors.

Hence, there is a need for enabling or easing replacing units of a gaming device, such as screens or touch screens, with other types of the units having other types of connectors and/or input/output protocols.

The present invention offers a solution to this problem by providing a universal controller for a gaming device having the features as defined in claim 1. Preferred embodiments of the invention are laid down in the depending claims and the specification.

In a first aspect of the invention the controller for gaming devices comprises interfaces connectable to various devices of the gaming device, such as a gaming processor, at least one screen, which is optionally configured as a touch screen, and a loud speaker. Each interface comprises a plurality of connectors selected from a video input connector, a video output connector, an audio input connector, an audio output connector, a touch screen signal input connector, a touch screen signal output connector, a command line connector and/or a data connector. The controller routes signals received at an input connector of a first interface to an output connector of a second interface being assigned to said signal, wherein the controller translates a communication protocol used by the signals received at the input connector of the first interface to a communication protocol used by the output connector of the second interface.

The present invention allows to replace input and output devices, such as touch screens and screens of a gaming device with any other type of said input and output devices, regardless which standard types of connectors the replaced and the replacing devices are provided with, since all usual connector types are implemented and, if necessary, the signals (particularly video and touch screen signals) are translated to the required communication protocol.

Another advantage of the invention is the possibility to replace screens without touch screen function by touch screens, to use them for the player online system communication or for additional games provided by the online system.

Nevertheless the replacement of standard screens by touch screens is not obligatory, since the standard input facilities of the gaming device and the online system can be used, too.

For an automatic operation of the controller without the need for set-up work carried out by personel the controller is configured to detect which connectors of the interfaces are connected to a device and, if necessary, to translate the signal to the communication protocol used by the detected connectors.

In order to allow a communication between the electronic gaming device and an online system it is suggested that at least one of the interfaces is connectable to an online system.

In one embodiment of the invention the controller is configured to receive commands from the online system and to route video signals received from the gaming processor and the online system via interfaces to screens via interfaces, wherein the controller switches the received video signals to selected screens in accordance with definitions contained in the commands. Alternatively, the controller is configured to receive video signals from the gaming processor and the online system via interfaces, to create an overlay of the received video signals and to switch the overlay to at least one screen via an interface. Both embodiments are useful for universal operation of the electronic gaming device.

Similarly, the controller may be configured to receive commands from the online system and to route audio signals received from the gaming processor and the online system via interfaces to the loudspeaker via an interface in accordance with definitions contained in the commands. An alternative embodiment of the controller is configured to receive audio signals from the gaming processor and the online system via interfaces, to create an overlay of the received audio signals and to send the overlay to the loudspeaker via an interface.

In a preferred embodiment of the invention the controller routes touch screen signals received from the screens configured as touch screens to either the gaming processor or the online system depending on which of the gaming processor or the online system sends video signals to the screens.

For ease of maintenance and replacement of faulty parts the interfaces are preferably configured as plug-in boards.

The controller according to the invention is configured as a plug-in board, which is inserted in the electronic gaming device as intermediary between gaming processor (configured as a CPU) and top screen, gaming screen and loudspeakers. If an online system is available, the universal controller (also referred to as universal touch controller) is also connectable with the online system. For the connection to the various components of the electronic gaming device the universal controller offers different connection types, which are commonly in use for the electronic gaming device components, e.g.: RS232, RS485, DVI, VGA, HDMI, USB A/B, USB Mini A/B USB Micro A/B and so on. The universal controller recognizes which connectors are used and, if necessary, translates the signal to another communication protocol.

Exemplary embodiments of the invention will be explained below with reference to the drawings, wherein FIG. 1*a*, FIG. 1*b*, FIG. 1*c* show schematic block diagrams of electronic gaming devices according to the present invention;

Figure 1A:
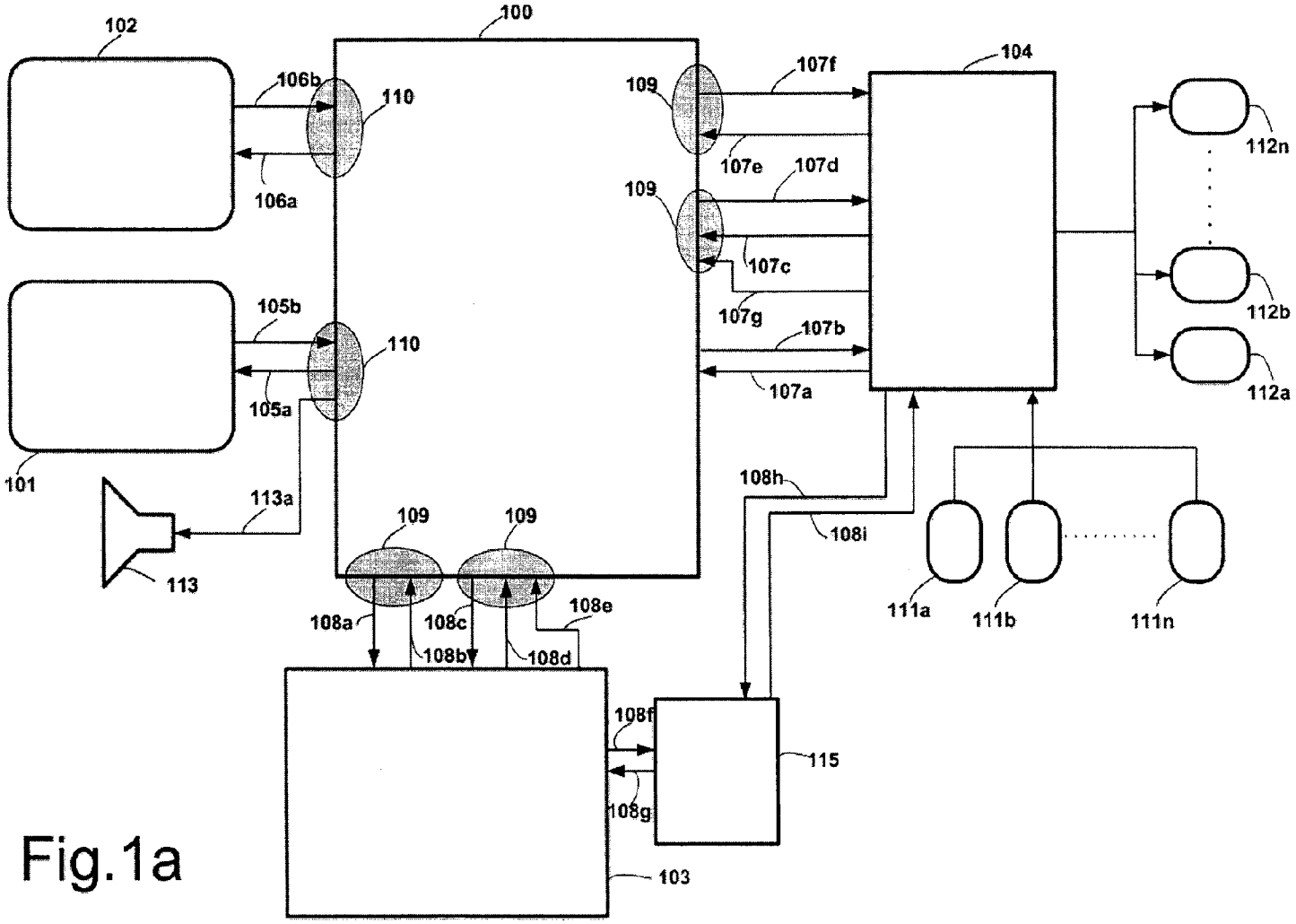
Figure 1B:
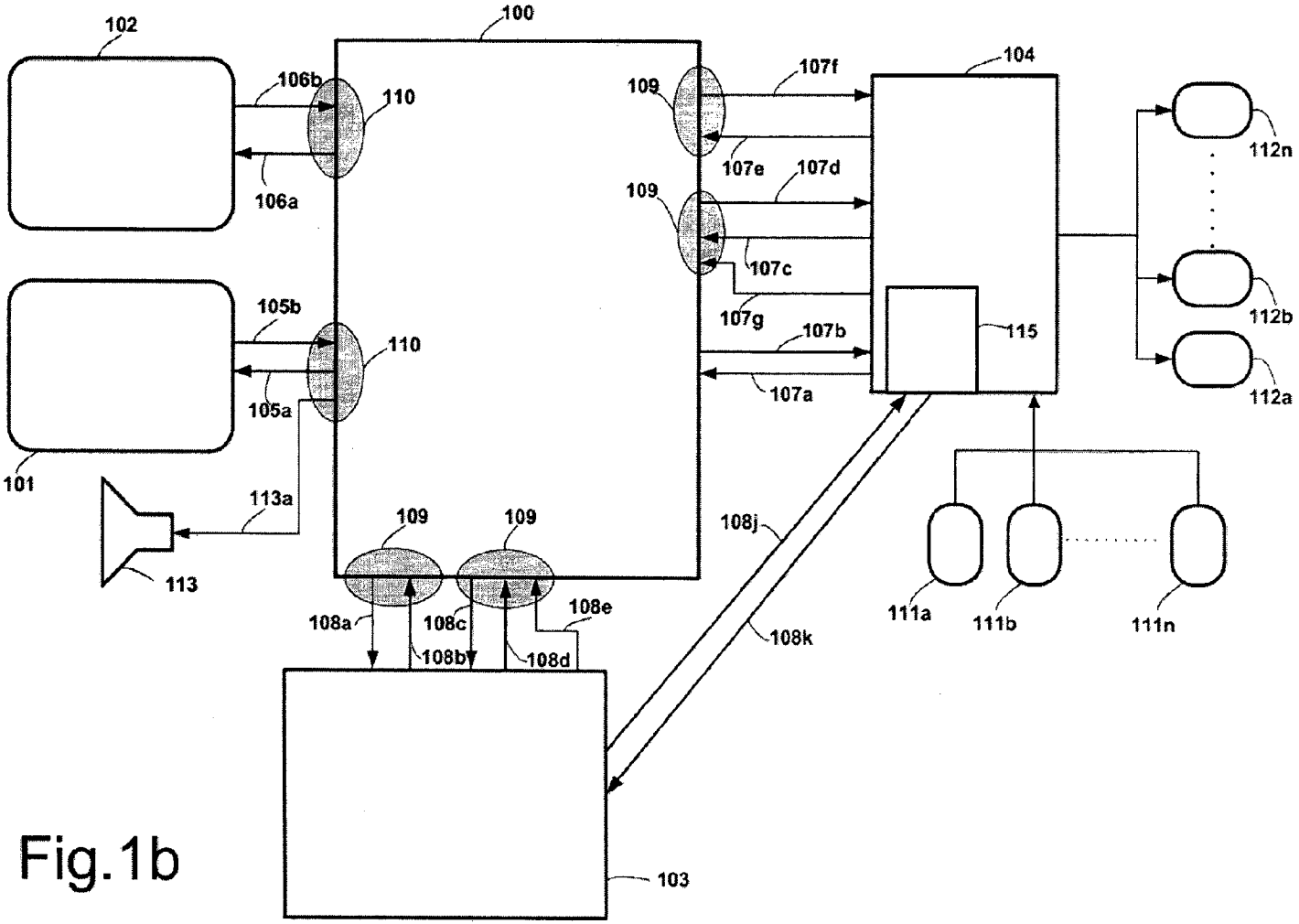
Figure 1C:
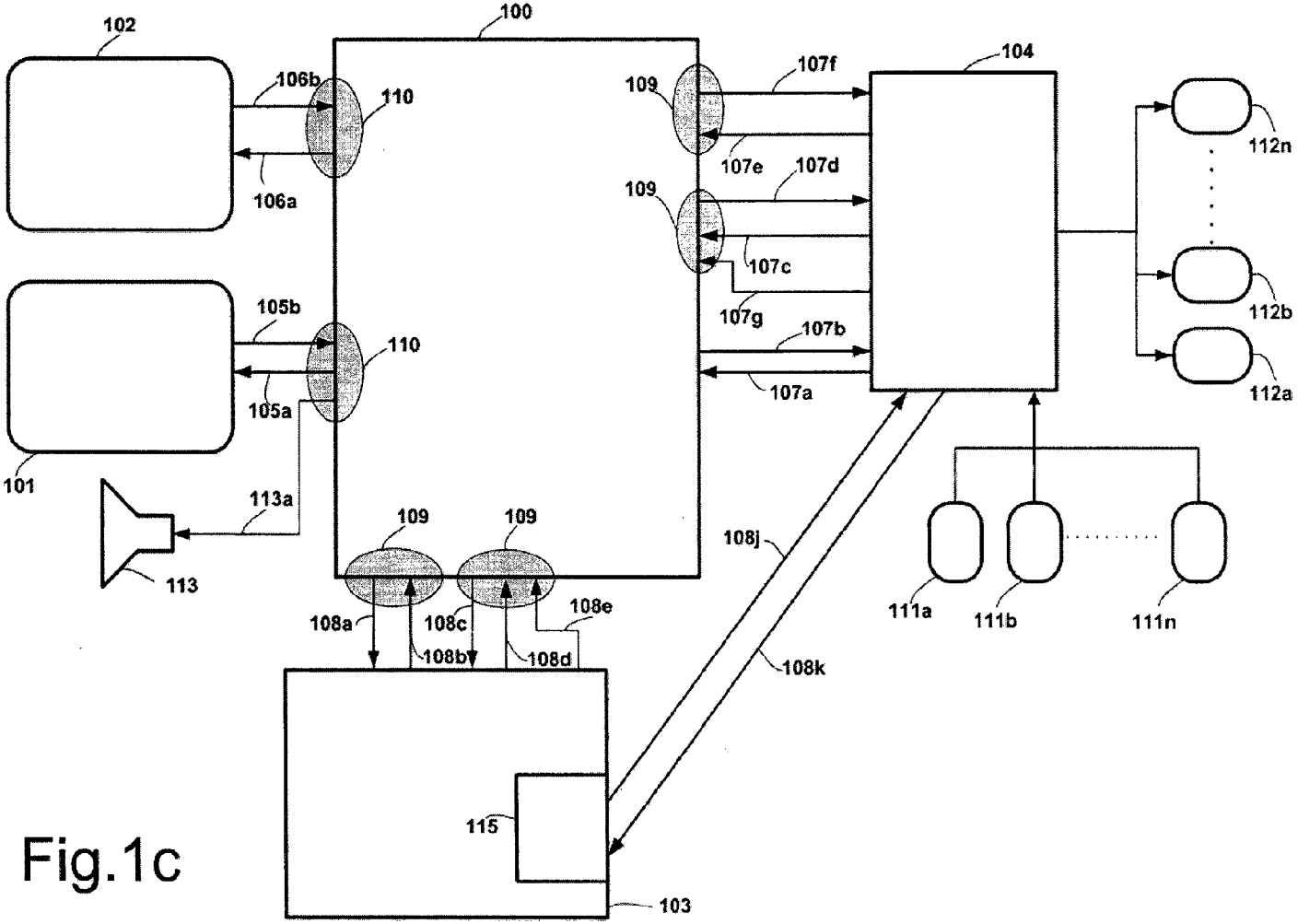

Reference is now made to FIGS. 1*a*, 1*b*, 1*c* depicting three embodiments of an electronic gaming device according to the present invention. All these embodiments are equipped with two touch screens, i.e. a so called top screen 102 and a gaming screen 101, further with an online system 104 for data collection, cashless transactions, monitoring, bonusing, player tracking, point of sales, casino promotions, other promotions, etc., which is configured to send video signals to both screens 101, 102 and to receive touch screen signals from both screens 101, 102. All three embodiments of an electronic gaming device further comprise the following components:

- a gaming processor 103, comprising or being configured as a central processing unit (CPU);
- a so called slot machine interface board 115, which can either be configured as a separate interface board connecting the online system 104 and the gaming processor 103 (FIG. 1*a*), or as a part of the part of the online system 104 (FIG. 1*b*), or as a part of the gaming processor 103 (FIG. 1*c*);
- the universal controller 100 for handling the various input and output signals of the devices of the electronic gaming device, which universal controller 100 is also referred to herein as universal touch controller due to its ability to handle communication with touch screens;
- a loudspeaker 113;
- input devices 111*a*, 111*b*, 111*c* . . . 111*n* of the online system, such as devices for booking money to the credit meter (configured as card readers, ticket readers, etc. online system buttons or extra touch screens of the online system;
- output devices 112*a*, 112*b*, 112*c* . . . 112*n* of the online system, such as devices for cashout (configured as ticket printers, card readers, etc.) or player tracking devices;
- connector interfaces 110 configured as plug-in boards, for connecting the screens 101, 102 to the universal controller 100; and
- connector interfaces 109 configured as plug-in boards, for connecting the online system 104 and the gaming processor 103 to the universal controller 100.

In the embodiment of the electronic gaming device according to FIG. 1*a* the slot machine interface board 115 is a separate system component. In case of online system 104 running a data collection process, data collection communication runs from the gaming processor 103 to the slot machine interface board 115 and vice versa via data connections 108*f* and 108*g*. The data collection communication further runs from the slot machine interface board 115 to the online system 104 and vice versa via connections 108*h* and 108*i*.

In the embodiment of the electronic gaming device according to FIG. 1*b* the slot machine interface board 115 is part of the online system 104. In case of online system 104 running the data collection, data collection communication between the online system 104 and the gaming processor 103 runs via data connections 108*j* and 108*k*.

In the embodiment of the electronic gaming device according to FIG. 1*c* the slot machine interface board 115 is implemented in the electronic gaming device and part of the gaming processor 103. In case of online system 104 running the data collection, data collection communication between the online system 104 and the gaming processor 103 runs via data connections 108*j* and 108*k*.

The universal touch controller 100 receives and processes different input signals from various devices of the electronic gaming device, as shown in FIGS. 1*a*, 1*b*, 1*c*:

- Commands and data are sent from the online system 104 via data connection 107*a*.
- For each screen, i.e. gaming screen 101 and top screen 102 separate video signals are sent from the gaming processor 103 to the universal controller 100 via video connections 108*b* and 108*d*.
- The online system 104 sends separate video signals for the screens 101, 102 via two video connections 107*c* and 107*e* to the universal controller 100.
- In case of using touch screens(such as in the present embodiments of the invention), touch screen signals are sent from the top screen 102 to the universal controller 100 via a touch screen signal connection 106*b* and from the gaming screen 101 via a touch screen signal connection 105*b*.
- In case of not using HDMI connections for sending the video signals from the gaming processor 103 to the universal controller 100, which HDMI connections also carry the audio signals, a gaming audio signal is sent from the gaming processor 103 via audio connection 108*e* to the universal controller 100.
- In case of not using HDMI connections for sending the video signals from the online system 104 to the universal controller 100, which HDMI connections also carry the audio signals, a gaming audio signal is sent from the online system 104 via connection 107*g* to the universal controller 100.

The universal touch controller 100 sends different output signals to various devices of the electronic gaming device, as shown in FIGS. 1*a*, 1*b*, 1*c*:

Data are sent to the online system 104 via data connection 107*b*.

Video signals are sent to the screens 101 and 102 via video connections 105*a* and 106*a*.

In case of using touch screens, touch screen signals relevant for gaming are sent to the gaming processor 103 via touch screen signal connections 108*a* and 108*c*.

In case of using touch screens, touch screen signal relevant for the online system are sent to the online system 104 via touch screen signal connections 107*d* and 107*f*.

In case of not using HDMI connections for sending the video signals from the universal controller 100 to the screens 101 and/or 102, the gaming audio signal is sent from the universal controller 100 via an audio connection 113*a* to the loudspeaker 113.

There are different states in the interaction among the universal controller 100, the gaming processor 103 and the online system 104:

During a standard gaming process the video signal for the gaming screen 101 is produced by the gaming processor 103 and is sent via video connection 108*b* to the universal controller 100 and forwarded from the universal controller 100 to the gaming screen 101 via video connection 105*a*. The video signal for the top screen 102, e.g. having the function of a pay table, is produced by the gaming processor 103 and is sent from it to the universal controller 100 via video connection 108*d* and forwarded from the universal controller 100 to the top screen 102 via video connection 106*a*. The audio signal for gaming is produced by the gaming processor 103 and is sent from it to the universal controller 100 via audio connection 108*e* and forwarded from the universal controller 100 to the loudspeaker 113 via audio connection 113*a*. Alternatively, in case of using HDMI video signal transmission, the audio signal is sent together with the video signal for the gaming screen via video communication 105*a*. The touch screen signal created in the gaming screen 101 is sent via the universal controller 100 to the gaming processor 103. If necessary, the signals are translated from one protocol which is used by one selected connector of one plug-in board interface 110 to a different protocol which is used by another connector of the plug-in board interface 109, which the gaming processor 103 is connected to.

When the electronic gaming device is not used by a player, video signals are sent to the screens 101 and 102 either from the gaming processor 103 or the online system 104, or the gaming processor 103 and the online system 104 share the screens 101, 102 to present information about the game and e.g. advertisement. In case of sharing the screens, the online system 104 sends the command to share the screens via connection 107*a*, together with information which screen is to be used for presenting information from gaming processor 103 and which screen is to be used to present information from the online system 104. The universal controller 100 receives the command from the online system 104 and switches the video signals to the screens, which were defined in the command and, if necessary, translates the signals. The touch screen signals from the screens 101, 102 are sent either to the gaming processor 103 or to the online system 104, depending on whether the gaming processor 103 or the online system 104 provides the video signals for the screen. If necessary the touch screen signal is translated from the protocol which is used by the selected connector of the screen plug-in board interface 110 to the protocol which is used by the connector which is selected of the processor plug-in board interface 109. The audio signal which is sent from the universal controller 100 to the loudspeaker 113 is also defined by a command from the online system 104. It can be either an audio signal from the gaming processor 103 or the audio signal from the online system 104 or an overlay of both of them.

When a trigger is set to start an information sequence from the online system 104 or to start a communication sequence between the online system 104 and a person at the electronic gaming device, who can be a player or casino personnel, the online system 104 sends a command to the universal controller 100 to share the screens as needed for the special case. If necessary, the video signals from the gaming processor 103 and the online system 104 are translated from the protocol which is used by the selected connector of the processor plug-in board interface 109 to the protocol which is used by the connector which is selected of the screen plug-in board interface 110.

In the following, some operating examples are given:

The gaming screen 101 is used by the online system 104 for communication with the player or casino personnel. The gaming video content created by the gaming processor 103, which is usually presented on the gaming screen 101 during standard gaming, is switched to the top screen 102.

The gaming screen 101 is used by the gaming processor 103, while the online system 104 presents advertisement, live gaming video feed or side games at the top screen 102.

The video signal which is sent to the gaming screen 101 and top screen 102 can be an imagery overlay of the video signals sent from the gaming processor 103 and the online system 104. The overlay is produced by the universal controller 100 initiated by the online system 104 by sending a command to the universal controller 100.

In case of using a touch screen as the top screen 102, the online system 104 can offer additional games for the patron.

All other possible combinations of using the gaming screen 101 and the top screen 102 for presenting information from the gaming processor 103 and the online system 104 are applicable.

There are several events which can trigger an interaction between a player and the online system communication. Triggers can be caused by the player when using input devices 111*a*, . . . 111*n* or output devices 112*a*, . . . 112*n*. For example, the insertion of a player card, the ticket insertion in the ticket reader, the bill insertion in the bill acceptor, the player pressing the cashout button, the player using the service button, etc. are player caused triggers. On the other hand, triggers can be caused by the online-system 104. For example, the start of a new jackpot, the start of a tournament, special offers from the player tracking program, casino advertisement, other advertisement, live gaming video feed, side games offered by the online system, etc. are online system caused triggers.

Figure 2:
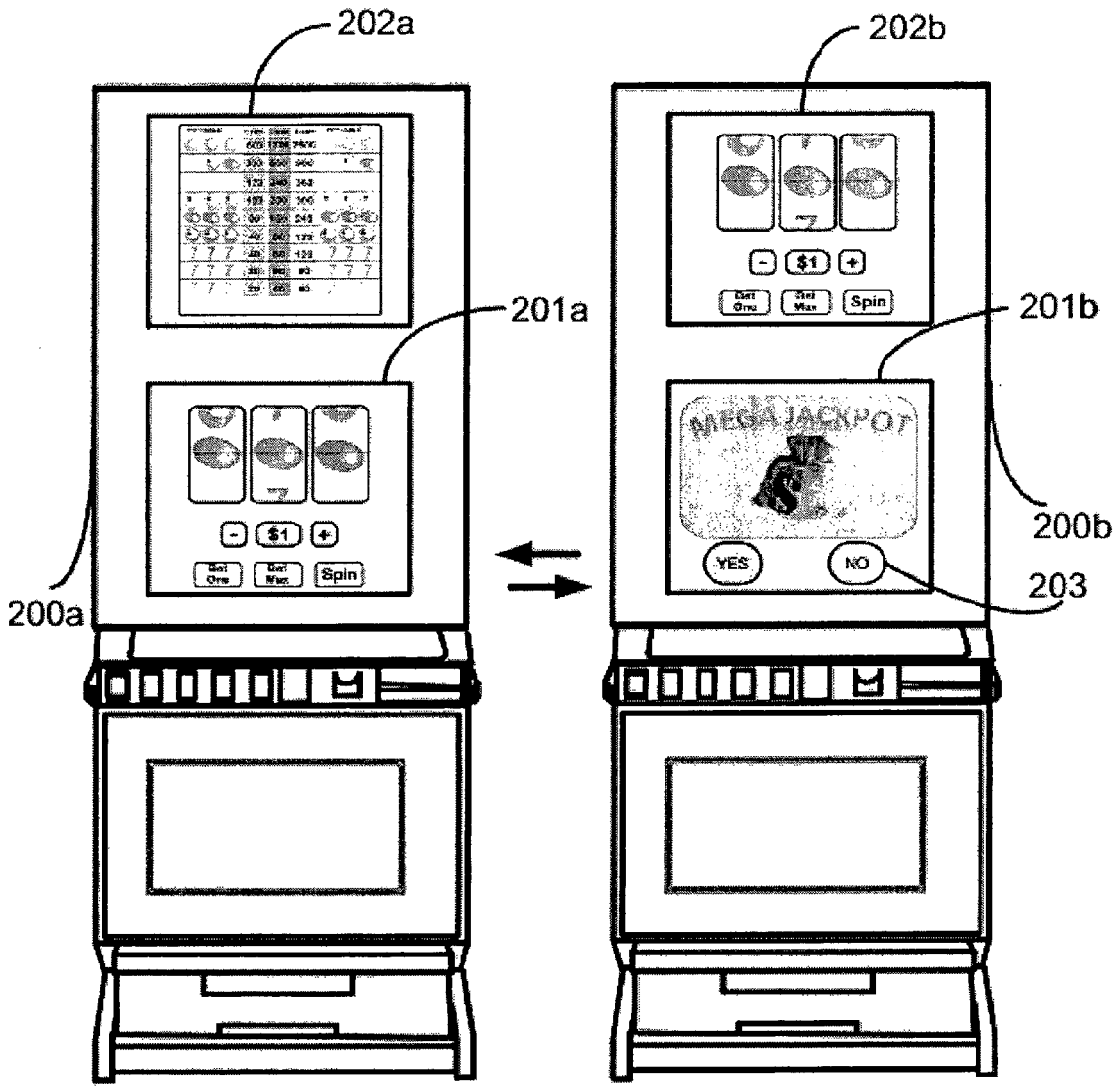
FIG. 2 shows one possible scenario for screen switching of the electronic gaming device.

FIG. 2 shows one possible scenario for screen switching of electronic gaming devices. On the left side a first electronic gaming device 200*a* can be seen during a standard gaming period. The gaming screen 201*a* shows the gaming content which is sent from the gaming processor; the top screen 202*a* shows the pay table. When the online system wants to send information to the player the electronic gaming device is switched into another state, as can be seen at the second electronic gaming device 200*b* at the right side of FIG. 2. The information for the player (e.g. information about a "mega party jackpot") is displayed on the gaming screen 201*b* and the gaming information has been switched to the top screen 202*b*. When the interaction between the player and the online system is stopped (e.g. by choosing the touch screen NO-button 203), the screens 201*b*, 202*b* are switched back again to the state of the left electronic gaming device 200*a*.

Figure 3:
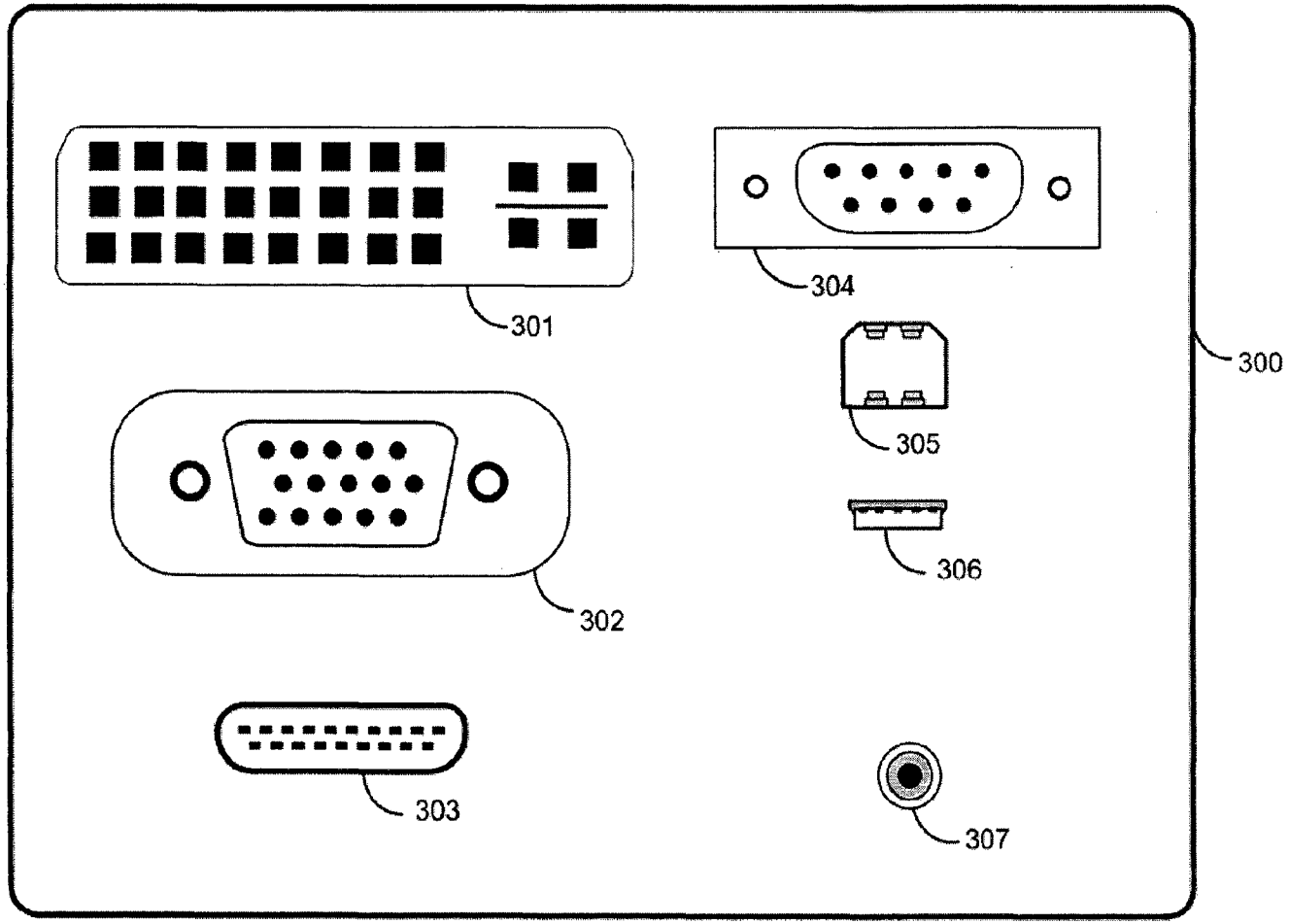
FIG. 3 shows an embodiment of an interface according to the invention, having various standard connectors.

FIG. 3 shows an embodiment of the interface 109 used in the electronic gaming devices according to FIGS. 1*a*, 1*b*, 1*c* for the connection between the universal controller 100 and the gaming processor 103 or the online system 104. This interface 109 is provided with a DVI connector 301, a VGA connector 302 and a HDMI connector 303 for video-in connection, further with a RS232 connector 304, a USB-B connector 305 and a USB-mini connector 306 for outgoing touch screen signals, and finally with an audio connector 307.

Figure 4:
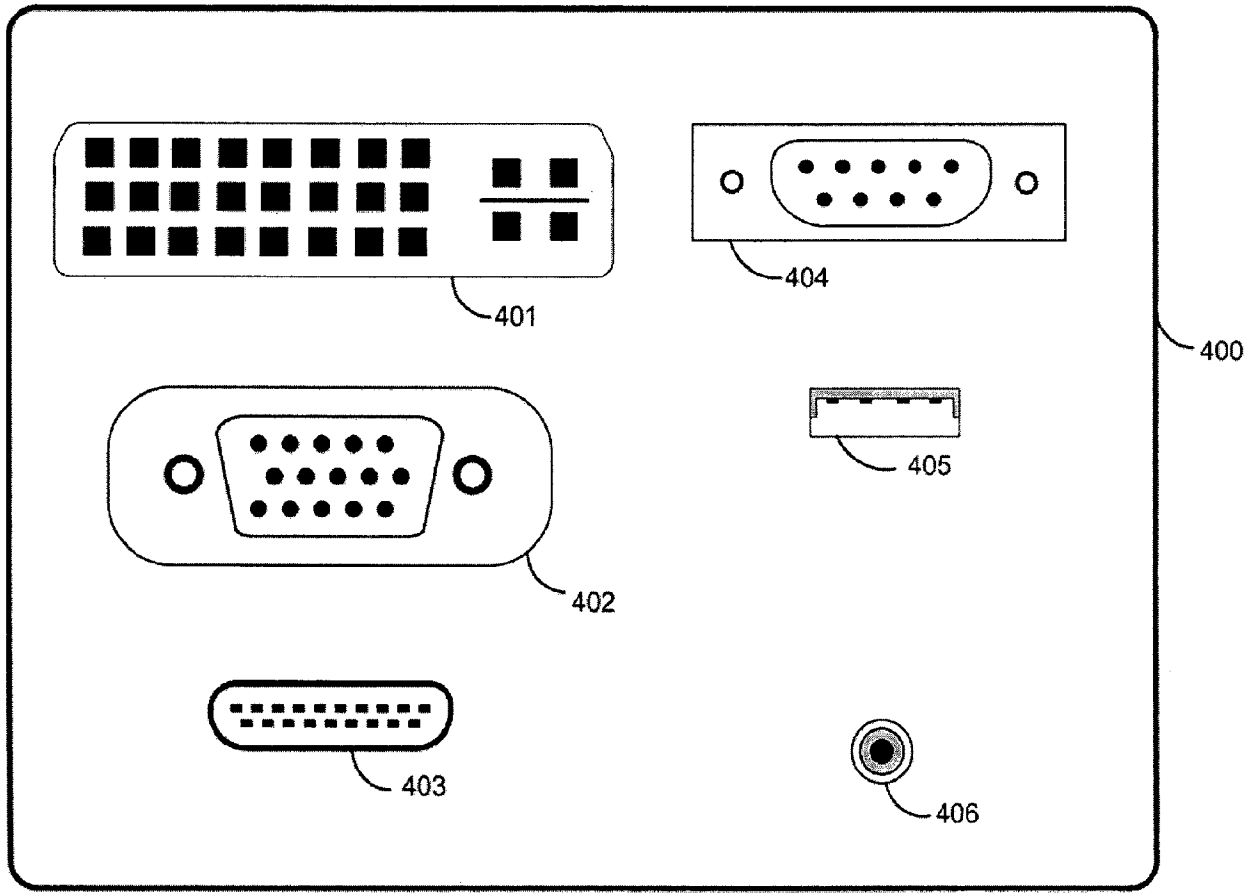
FIG. 4 shows another embodiment of an interface with various standard connectors according to the invention.

FIG. 4 shows an embodiment of the interface 110 used in the electronic gaming devices according to FIGS. 1*a*, 1*b*, 1*c* for the connection between the universal controller 100 and the screens/touch screens 101 and 102. This interface 110 is equipped with a DVI connector 401, a VGA connector 402 and a HDMI connector 403 for video-out connection, further with a RS232 connector 404 and a USB-A connector 405 for incoming touch screen signals, and finally with an audio connector 406.

The invention claimed is:

1. A controller for casino gaming devices, wherein the controller is a plug-in board for automatic operation and comprises interfaces by which the controller is connectable as direct intermediary between a gaming processor, at least one touch screen, a loud speaker, and an online system, wherein each interface comprises a plurality of connectors selected from a video input connector, a video output connector, an audio input connector, an audio output connector, a touch screen signal input connector, a touch screen signal output connector, a command line connector and a data connector, wherein the controller is configured to detect which connectors of the interfaces are connected to a device and routes signals received at an input connector of a first interface to an output connector of a second interface being assigned to said signal, wherein the controller translates a communication protocol used by the signals received at the input connector of the first interface to a communication protocol used by the output connector of the second interface, wherein the controller is configured to receive commands, touch screen signals, video signals and audio signals from the gaming processor and the online system via interfaces, wherein the commands are triggered by input devices or output devices of the online system, wherein the controller is configured to create an overlay of the received video signals and to switch the overlay to at least one screen via an interface, and wherein the controller is configured to create an overlay of the received audio signals and to send the overlay to the loudspeaker via an interface.

2. The controller according to claim 1, characterized in that the controller is configured to route video signals received from the gaming processor and the online system via interfaces to screens via interfaces, wherein the controller switches the received video signals to selected screens in accordance with definitions contained in the commands.

3. The controller according to claim 1, characterized in that the controller is configured to route audio signals received from the gaming processor and the online system via interfaces to the loudspeaker via an interface in accordance with definitions contained in the commands.

4. The controller according to claim 1, characterized in that the controller routes touch screen signals received from the screens configured as touch screens to either the gaming processor or the online system depending on which of the gaming processor or the online system sends video signals to the screens or screen parts.

5. The controller according to claim 1, characterized in that the connectors of the interfaces comprise at least one of RS232, RS485, DVI, VGA, HDMI, USB A/B, USB Mini A/B, USB Micro A/B and/or audio connectors.

6. The controller according to claim 1, characterized in that the interfaces are configured as plug-in boards.

* * * * *